US006132240A

United States Patent [19]

Daoud

[11] Patent Number: 6,132,240

[45] Date of Patent: Oct. 17, 2000

[54] PRINTED WIRING BOARD ASSEMBLY FOR A CONNECTOR WITH STRAIN RELIEF AND TERMINAL ISOLATION

[75] Inventor: Bassel H. Daoud, Parsippany, N.J.

[73] Assignee: Lucent Technologies Inc., Murray Hill, N.J.

[21] Appl. No.: 09/404,168

[22] Filed: Sep. 24, 1999

[51] Int. Cl.[7] ..... H01R 13/58

[52] U.S. Cl. ..... 439/458; 439/493

[58] Field of Search ..... 439/325, 458, 439/493, 876, 67, 77, 83, 496; 361/428, 413, 424

[56] References Cited

U.S. PATENT DOCUMENTS

| | | | |
|---|---|---|---|
| 2,850,712 | 9/1958 | Franklin | 439/458 |
| 3,065,444 | 11/1962 | Crimmins | 439/458 |
| 3,065,445 | 11/1962 | Crimmins | 439/458 |
| 3,432,794 | 3/1969 | Churla | 439/493 |
| 4,974,121 | 11/1990 | Masuko et al. | 361/428 |

*Primary Examiner*—Renee Luebke
*Assistant Examiner*—Antoine Ngandjui
*Attorney, Agent, or Firm*—Davis L. Davis

[57] ABSTRACT

A printed wiring board for connection to solder tails of connector terminals has conductive traces connected to respective wires of a ribbon cable. The ribbon cable is wrapped around an end of the board to provide strain relief to its connection to the board and then is disposed over the exposed ends of the solder tails. At the other end of the board, the cable is held by a retainer, thereby protecting the solder tails from being short circuited by inadvertent contact with a conductive object.

4 Claims, 2 Drawing Sheets

PRINTED WIRING BOARD ASSEMBLY FOR A CONNECTOR WITH STRAIN RELIEF AND TERMINAL ISOLATION

BACKGROUND OF THE INVENTION

This invention relates to a printed wiring board assembly for use with a connector and, more particularly, to such an assembly which provides strain relief for a cable secured to the printed wiring board and provides protective isolation to connector terminal solder tails extending through the printed wiring board.

The connector with which the present invention finds utility has a plurality of elongated conductive terminals each having first and second ends along the longitudinal axis of each terminals. A substantially planar insulative base holds the plurality of terminals in a parallel spaced array with the axes of the terminals orthogonal to the base and with the first ends of all of the terminals extending outwardly from a first side of the base. The first ends of the terminals are sometimes called solder tails and extend through openings in a printed wiring board. These openings are plated through-hole and a wave soldering operation is performed to secure the tails to the board and electrically connect the tails to respective ones of the plated through-holes. The plated through-holes are connected to conductive traces on the board to which wires of a cable are connected. These wires are susceptible to damage resulting from their movement. It would therefore be desirable to provide strain relief for the connection of the wires to the board.

Further, the tails extend through the board and are exposed on the side of the board away from the connector. These tails can be short circuited if they inadvertently contact a conductive object. It would therefore be desirable to isolate the exposed tails to prevent them from being inadvertently short circuited.

SUMMARY OF THE INVENTION

According to the present invention, there is provided a printed wiring board assembly for use with a connector having a plurality of elongated conductive terminals each having first and second ends along the longitudinal axis of each terminal, and a substantially planar insulative base holding the plurality of terminals in a parallel spaced array with the axes of the terminals orthogonal to the base and with the first ends of all of the terminals extending outwardly from a first side of the base. The inventive assembly includes a printed wiring board having a plurality of openings arranged in an array corresponding to the array of the plurality of terminals and a plurality of conductive traces each extending from a respective opening toward a first end of the board. A ribbon cable has a plurality of conductive wires encased in an insulative flexible cover, the wires each being connected on a first side of the board to a respective one of the conductive traces. A cable retainer is provided at a second end of the board. The board is placed over the connector with the first ends of the terminals extending through respective ones of the board openings and with the first side of the board facing the connector base. The cable is wrapped around the first end of the board and is disposed over the first ends of the terminals extending through the board openings beyond the second side of the board. The cable is then installed in the cable retainer.

In accordance with an aspect of this invention, the board is formed with an enlarged opening having opposed lateral projections therein to form the cable retainer.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
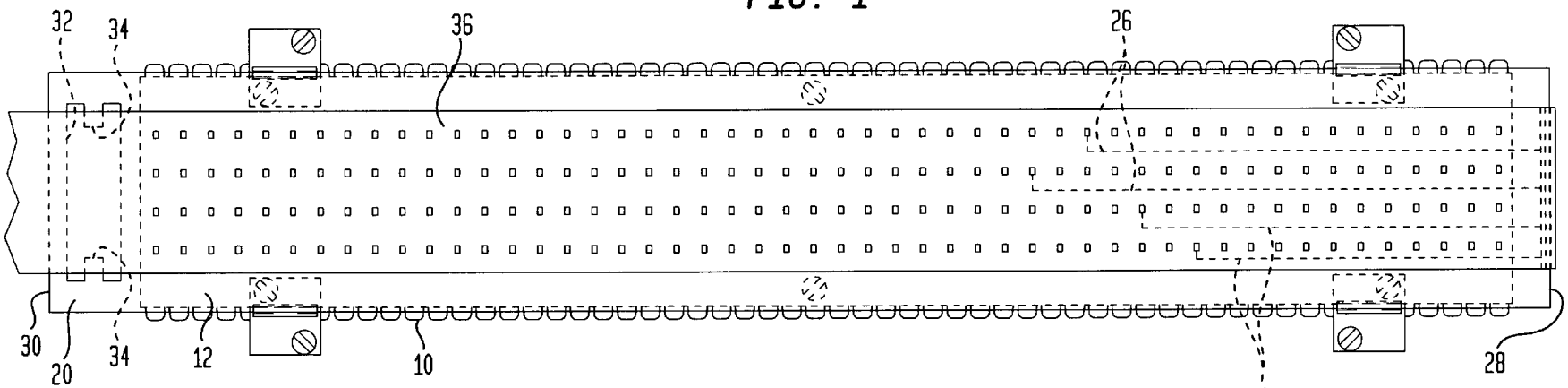
FIG. 1 is a plan view showing an illustrative embodiment of a printed wiring board assembly according to the present invention installed on a connector.

Referring to the drawings, the connector 10 has a substantially planar insulative base 12. A plurality of elongated conductive terminals 14 have first and second ends 16, 18, respectively, along a longitudinal axis of each terminal 14. The base 12 holds the terminals 14 in a parallel spaced array with the axes of the terminals 14 orthogonal to the base 12, and with the first ends 16 of all of the terminals 14 extending outwardly from a first side of the base 12. These first ends 16 are the solder tails of the terminals 14.

A printed wiring board 20 having a plurality of plated through-holes arranged in an array corresponding to the array of the plurality of terminals 14 is disposed over the solder tails 16 with a first side 22 of the board 20 facing the connector 10 and the solder tails 16 extending outwardly beyond the second side 24 of the board 20. The printed wiring board 20 further has a plurality of conductive traces 26 extending from respective ones of the plated through-holes toward a first end 28 of the board 20. At its second end 30, the board 20 is formed with a substantially rectangular opening 32. The opening 32 has opposed lateral projections 34 extending thereinto, as clearly shown in FIG. 1.

Figure 2:
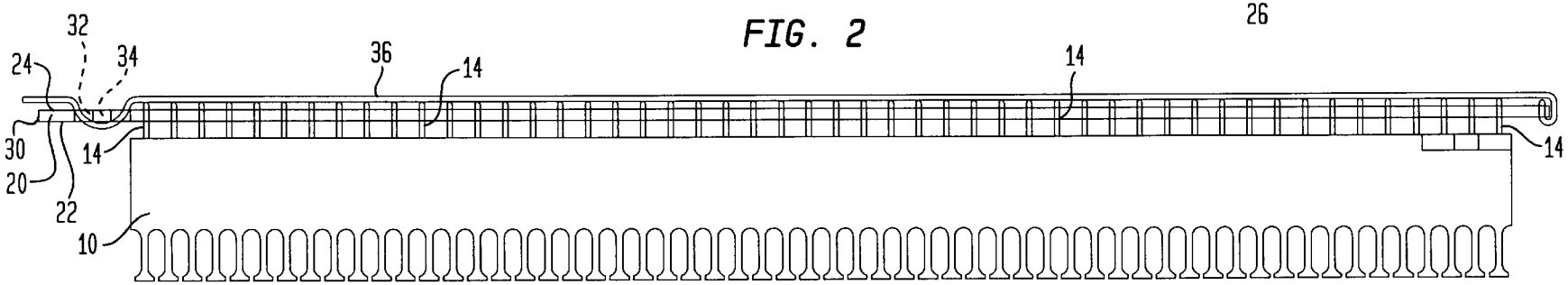
FIG. 2 is a side view of the printed wiring board assembly and connector of FIG. 1.
Figure 3:
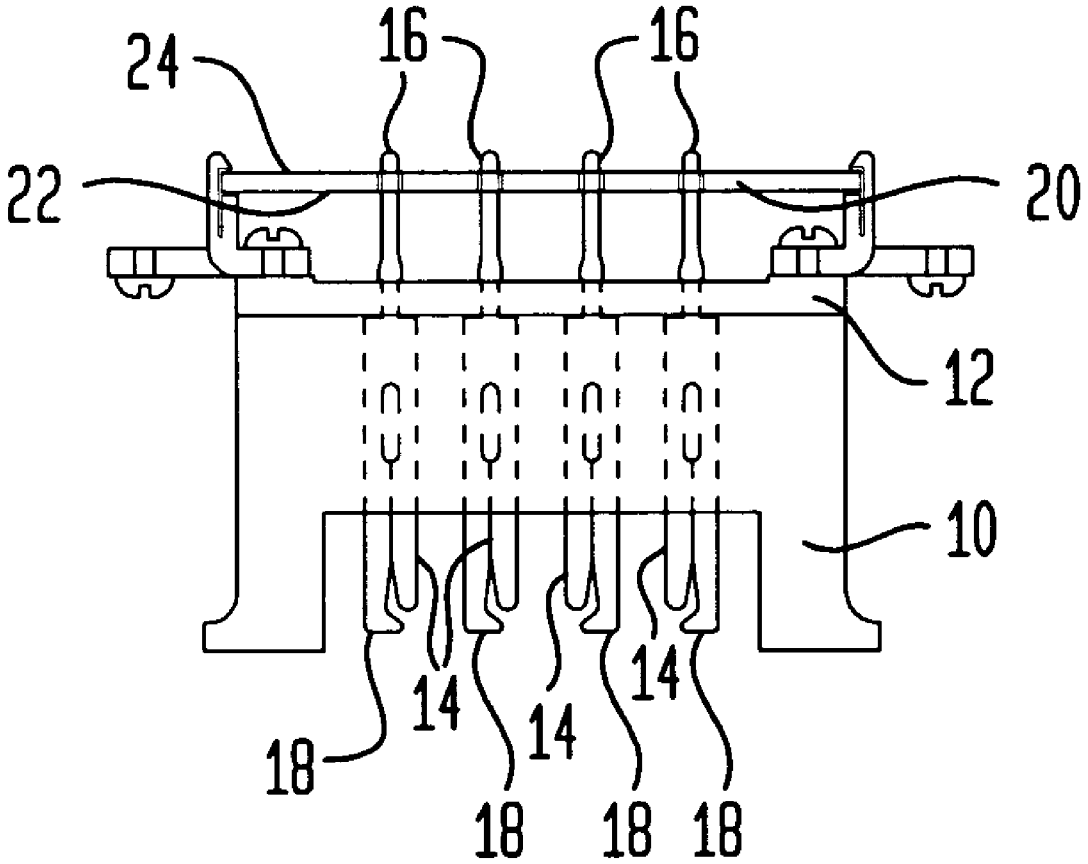
FIG. 3 is an end view of the printed wiring board, without the cable, installed on the connector.

A ribbon cable 36 having a plurality of conductive wires encased in an insulative flexible cover, as is conventional, has its wires each connected on the first side 22 of the board 20 and at the first end 28 of the board 20 to a respective one of the conductive traces 26. During assembly, the cable 36 is first connected to the board 20. The board 20 is then placed over the solder tails 16 with the first side 22 of the board 20 facing the connector 10. A wave soldering operation is then performed to connect each solder tail 16 to a respective plated through-hole and, accordingly, to a respective conductive trace 26 and to a respective wire in the cable 36. The cable 36 is then tightly bent around the first end 28 of the board 20, as best shown in FIG. 2. This provides a strain relief effect for the connection of the wires of the cable 36 to the conductive traces 26. The cable 36 is then laid over the exposed ends of the solder tails 16 and is inserted under the opposed projections 34, as shown in FIGS. 1 and 2. This retains the cable 36 with the cable 36 overlying the otherwise exposed solder tails 16. This overlying of the cable 36 protects the solder tails 16 from being inadvertently short circuited and results in a cost reduction by eliminating the requirement for a separate cover over the connector 10. The bending of the cable 36 around the first end 28 of the printed wiring board 20 provides a strain relief effect which prevents a weakening of the connection between the wires of the cable 36 and the conductive traces 26 of the printed wiring board 20.

Accordingly, there has been disclosed an improved printed wiring board assembly which provides strain relief and terminal isolation. While an illustrative embodiment of the present invention has been disclosed herein, it is understood that various adaptations and modifications to the disclosed embodiment are possible and it is intended that this invention be limited only by the scope of the appended claims.

What is claimed is:

1. A printed wiring board assembly for use with a connector having a plurality of elongated conductive terminals each having first and second ends along a longitudinal axis of said each terminal, and a substantially planar insulative base holding said plurality of terminals in a parallel spaced array with the axes of the terminals orthogonal to the base, and with the first ends of all of the terminals extending outwardly from a first side of the base, the assembly comprising:

a printed wiring board having a plurality of openings arranged in an array corresponding to the array of the plurality of terminals and a plurality of conductive traces each extending from a respective opening toward a first end of the board;

a ribbon cable having a plurality of conductive wires encased in an insulative flexible cover, the wires each being connected on a first side of the board to a respective one of the conductive traces; and a cable retainer at a second end of the board;

wherein the board is placed over the connector with the first ends of the terminals extending through respective ones of the board openings and with the first side of the board facing the connector base, the cable is wrapped around the first end of the board and disposed over the first ends of the terminals extending through the board openings beyond the second side of the board, and the cable is installed in the cable retainer.

2. The assembly according to claim 1 wherein the board is formed with an enlarged opening having opposed lateral projections extending thereinto to form the cable retainer.

3. A connector comprising:

a plurality of elongated conductive terminals each having first and second ends along a longitudinal axis of said each terminal;

a substantially planar insulative base holding said plurality of terminals in a parallel spaced array with the axes of the terminals orthogonal to the base, and with the first ends of all of the terminals extending outwardly from a first side of the base;

a printed wiring board having a plurality of openings arranged in an array corresponding to the array of the plurality of terminals and a plurality of conductive traces each extending from a respective opening toward a first end of the board;

a ribbon cable having a plurality of conductive wires encased in an insulative flexible cover, the wires each being connected on a first side of the board to a respective one of the conductive traces; and a cable retainer at a second end of the board;

wherein the board is disposed over the connector with the first ends of the terminals extending through respective ones of the board openings and with the first side of the board facing the connector base, the cable is wrapped around the first end of the board and disposed over the first ends of the terminals extending through the board openings beyond the second side of the board, and the cable is installed in the cable retainer.

4. The connector according to claim 3 wherein the board is formed with an enlarged opening having opposed lateral projections extending thereinto to form the cable retainer.

* * * * *